United States Patent [19]

Bonnenfant et al.

[11] Patent Number: 4,679,696

[45] Date of Patent: Jul. 14, 1987

[54] CONTAINER AND SEALING ASSEMBLY

[75] Inventors: Yvon Bonnenfant, Vittel; Philippe Odet, St. Georges; Raymond Perne, Anse, all of France; Claude Thevenot, D.Om Joao, Portugal

[73] Assignees: Societe Generale des Eaux Minerales de Vittel, Vittel; Astra Plastique, St. Georges de Reneins, both of France

[21] Appl. No.: 727,534

[22] Filed: Apr. 26, 1985

[30] Foreign Application Priority Data

Apr. 26, 1984 [FR] France ..... 84 06765

[51] Int. Cl.[4] ..... B65D 41/04

[52] U.S. Cl. ..... 215/252; 215/276

[58] Field of Search ..... 215/252, 276

[56] References Cited

U.S. PATENT DOCUMENTS

| | | | |
|---|---|---|---|
| 4,093,094 | 6/1978 | Smaller et al. | 215/276 |
| 4,473,163 | 9/1984 | Geiger | 215/276 X |
| 4,493,427 | 1/1985 | Wolkonsky | 215/252 X |
| 4,511,053 | 4/1985 | Brandes et al. | 215/252 |

*Primary Examiner*—Donald F. Norton

*Attorney, Agent, or Firm*—Weiser & Stapler

[57] ABSTRACT

A disposable container is provided with a unitary sealing assembly having the capability for indicating that the container has not been opened and including a disc portion for enclosing the opening of the container and a seal portion positioned between the disc portion and the opening of the container, and a threaded collar for engaging the opening of the container and for retaining the unitary sealing assembly to the opening of the container.

17 Claims, 2 Drawing Figures

CONTAINER AND SEALING ASSEMBLY

Figure 1A:
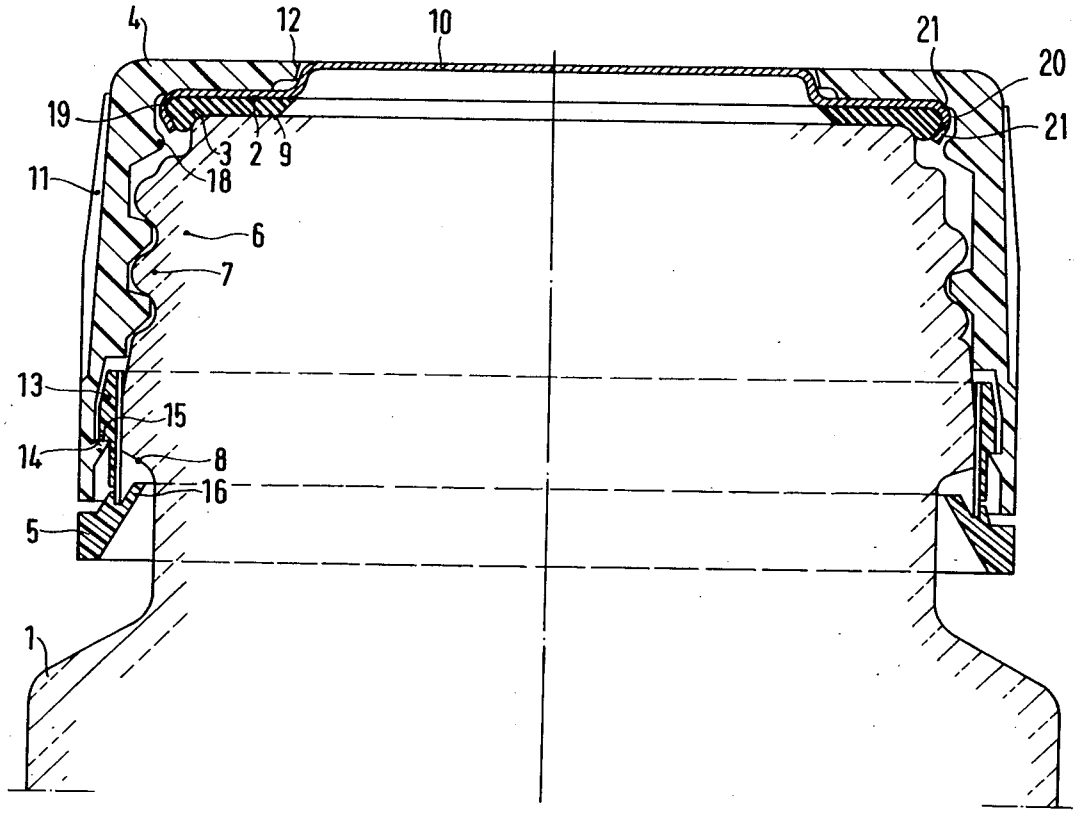

The present invention relates to a disposable container which is intended for the feeding, more particularly, of very young babies, and is referred to below as a "feeding bottle", the said feeding bottle and its contents being sterilised beforehand during packaging.

Sterilisation can be performed using any known method.

Containers of this type, where the feeding bottle consists in fact of a non-reusable packaging, are known. They are usually sold in a pack consisting of four or six containers filled, for example, with fruit juice and closed by a metal cap.

In order to use the container, the cap is removed and a teat is fixed onto the container by means of a collar which is screwed onto a corresponding threading provided on the container.

This arrangement is rather impracticable and has many drawbacks.

First of all, aseptic conditions are not always guaranteed since the same collar is used for all the containers in one pack. Furthermore, there is the danger that some unscrupulous person might steal the collar from a pack being sold in a shop, thereby making it difficult to use the said pack.

Finally, the metal caps do not ensure that the contents of the container are untouched and hence germ-free. There is, in fact, no way of the consumer knowing whether the container has been previously opened.

The object of the invention is to overcome these various drawbacks by proposing a packaging consisting of a single-use disposable feeding bottle which is reliable as regards germ-free conditions, which ensures that the contents are untouched and which is capable of resolving the problems of providing a sealing effect.

According to the invention, this result is obtained by a disposable container which is intended for the feeding, more particularly, of very young babies, of the type consisting of a "feeding bottle", the said feeding bottle and its contents being sterilised beforehand during packaging, characterised in that it is sealed by a sealing assembly which has means for ensuring that the container has not been opened and comprises a disc for sealing the neck of the feeding bottle, a seal being inserted between the said disc and the upper edge of the neck against which the latter bears, the disc being held in position by a collar which is screwed onto the neck and which comprises a security device.

Such an assembly is filled, for example, with fruit juice and sterilised as such.

Sealing is ensured both by the disc and the seal which are applied against the neck by the collar screwed onto the latter and by the partial vacuum resulting from sterilisation.

The sealing device comprises essentially, on the one hand, a disc on which a seal is placed, which seal is capable of absorbing imperfections and of applying itself elastically against the edge of the said neck without being made to rotate as a result, which latter effect would cause the seal to deteriorate and could lessen the sealing effect, and, on the other hand, a collar.

In order to ensure a perfectly leakproof closure, the collar is made from a rigid synthetic material which does not possess any sealing properties, but which, on the other hand, has a high tear strength.

The disc is made from any material which provides an absolute sealing effect against any release or penetration of gases. In particular, it must enable sterile conditions to be maintained.

It may, for example, be made of metal, the seal being applied against the periphery of the latter.

According to another embodiment, the disc and the seal may be formed as a single piece.

In view of the partial vacuum caused by sterilisation, inside the container, the disc is held against the upper edge of the said container by means of "suction".

So that the container can be opened without any particular effort, according to an advantageous embodiment of the invention the collar is provided with an internal circular projection, having an internal diameter less than the external diameter of the disc, over the entire internal circumference of the collar or in only one or more sectors of the latter.

Thus, without any particular effort, the collar can be unscrewed and the disc released by the projection, thereby breaking the vacuum created by sterilisation inside the container.

According to another advantageous embodiment of the invention, which optimises the manufacturing process, the discs may, on the other hand, be snapped into position in suitable receiving structures on the collar so that the assembly can be supplied as such, before being positioned on the bottle.

The container according to the invention comprises, in addition, a security device such as for example, but not exclusively, that described in French Patent Application No. 74/39911 to which special reference is made here.

In order to use the container, the collar must be unscrewed and hence separated by rotating the ring, and the collar and seal/disc assembly removed. A teat is then arranged on the feeding bottle and fixed to it by means of the collar.

Figure 1B:
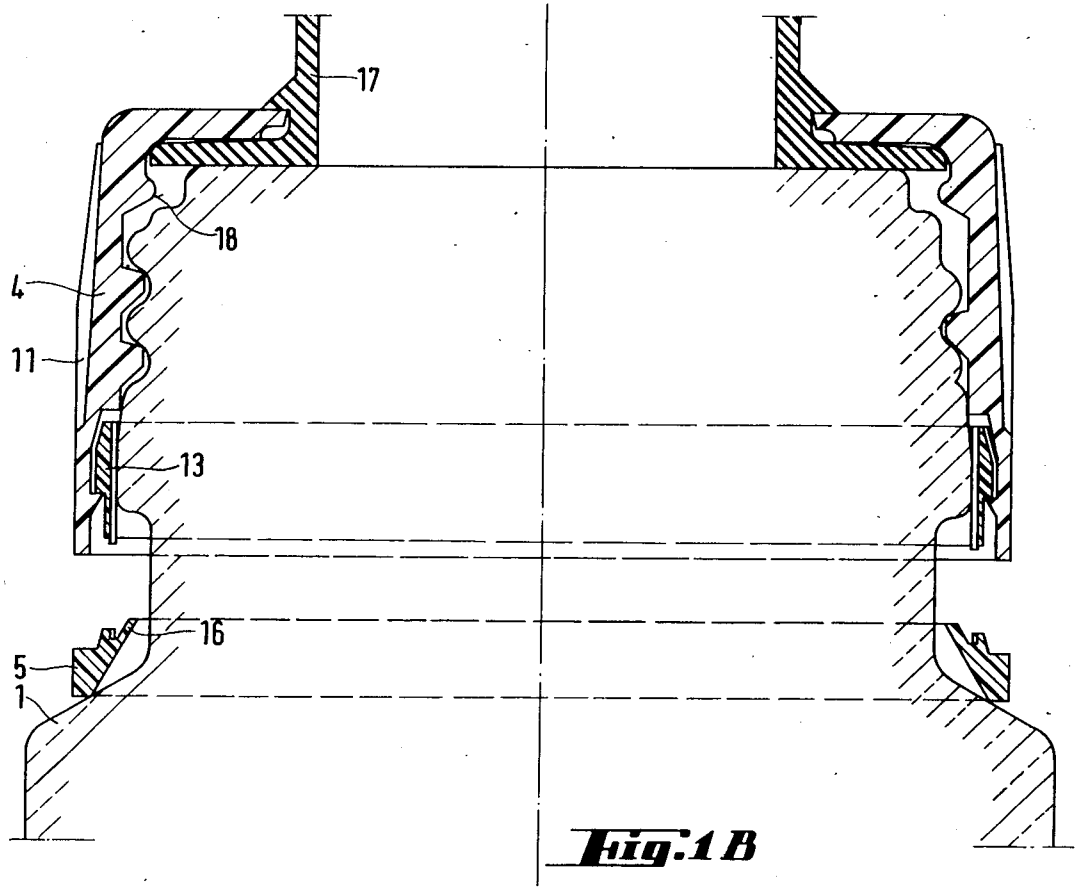

The invention will be better understood with the aid of the following description of an embodiment given by way of a non-limiting example, with reference to the attached drawings in which:

FIG. 1A is a partial view, in longitudinal section, of the neck of a container according to the invention which is sealed, FIG. 1B is a partial view, in longitudinal section, of the neck of a container according to the invention which is ready for use.

Reference will be made, first of all, to FIG. 1A.

The container according to the invention comprises, respectively:

a body (1),
a metal disc (2),
a seal (3),
a collar (4) connected to a safety ring (5).

The body (1) is generally made of glass or of any other synthetic material, the physical properties of which are compatible with the various processes, in particular sterilisation.

It has in the region of the neck (6):
an external threading (7),
a peripheral stopping rib (8), the function
of which will be described below.

The periphery of the metal disc (2) bears against the upper edge (9) of the said neck. A seal (3) is inserted in the region where the disc (2) and the edge (9) make contact. The central part of the disc (2) is preferably shaped in the manner of a projection (10), the purpose of which will be described below.

In order to obtain a perfect sealing effect, the disc (2) is held against the neck (6) by means of the collar (4) which is screwed onto the threading (7) of the container. This collar preferably has ribbing (11) which facilitate handling by the user.

In order to centre the disc (2) perfectly, the upper part of the collar (4) is recessed so as to form a chamfer (12) which co-operates with the projection (10) in order to position the disc (2) precisely.

To ensure that the container has not been opened, the collar (4) co-operates with the sealing ring (5) to which it is rigidly connected by means of a flange (13).

The flange (13) is made integral with ring (5) so as to form a weakening zone consisting of a line of reduced thickness or a succession of breakable bridging elements.

According to another embodiment, the collar (4), the flange (13) and the ring (5) are moulded as a single piece (i.e. unitary).

In the case of the Figure shown, the assembly (13, 5) is independent of the collar (4). The latter causes displacement of the flange (13) by means of a shoulder (14) which co-operates with a corresponding shoulder (15) on the flange.

The internal diameter of the flange is slightly greater than the external diameter of the stopping rib (8).

On the other hand, the security ring (5) has an annular recessed part (16), the internal diameter of which is less than the external diameter of the stopping rib (8).

When the user unscrews the collar (4), the latter moves upwards in relation to the container (1) so as to gradually release the plate (2). In doing so, the assembly (13, 5) follows the movements of the collar until the part (16) comes up against the stopping rib (8).

Increased pressure by the user therefore causes the bridging between the ring (5) and the flange (13) to break. The collar can then be completely unscrewed so that the disc (2) can be replaced by a teat (17).

The ring (5) falls onto the bottom of the body (1) of the container, thereby indicating that the container has been opened.

The internal structure of the upper part of the collar (4) will now be described.

As mentioned above, the sterilisation process performed on the container provided with the disc and the screwed-on collar leads, upon cooling, to the creation of a partial vacuum inside the bottle which tends to apply the disc (2) and the seal (3) against the neck of the bottle, independently of the collar.

During opening, this disc must therefore be separated, this being performed by means of a circular projection (18) provided over the entire circumference or only in one or more sectors of the inner face of the collar (4).

Opening the bottle for the first time does not require any special effort in order to break the security ring, and the projection forming part of the threaded collar then lifts off the sealing disc, thereby disrupting the vacuum created by hot-filling or pasteurisation.

The closing and opening torque is therefore perfectly suited to young people on account of the design consisting of three parts: security ring, sealing disc and threaded collar providing a good grip without, however, causing injury to the hands.

In order to optimise the process for manufacturing the embodiment of the containers according to the invention, the disc (2) and the collar (4) are advantageously made integral with each other before being screwed onto the bottle. This may be effected by means of the projection (18).

Advantageously, this may also be effected by snapping the disc into position in a suitable receiving structure provided on the collar, for example by performing an undercut on the peripheral zone of the projection (10) of the disc.

This structure is nevertheless intended to allow the disc to rotate freely in relation to the collar in such a way that the seal is always compressed when it is screwed on, in a non-rotatable manner, on account of its adherence to the glass.

To facilitate the foregoing operations, the periphery (19) of the disc (2) is preferably configured so that center portions (20) of the periphery (19) bow outwardly and so that edge portions (21) of the periphery (19) bow inwardly.

What is claimed is:

1. A disposable container having an opening and a sealing assembly having means for indicating that the container has not been opened, said sealing assembly comprising:

a sealing member having a disc for enclosing the opening of said container and a seal positioned between said disc and said opening; and a collar having means for engaging the opening of said container, for retaining said sealing member to the opening of said container;

wherein said disc has a central projection which is connected to the remainder of said disc by a sloping surface, and wherein said collar has a recess for receiving the central projection of said disc and a chamfer for receiving the sloping surface of said disc.

2. The disposable container and sealing assembly of claim 1 wherein said sealing assembly is made of a synthetic material.

3. The disposable container and sealing assembly of claim 2 wherein said disc and said seal are formed as a single piece.

4. The disposable container and sealing assembly of claim 1 wherein said collar has an inner surface, at least portions of which are provided with a circular projection for receiving said sealing member, and for removing said sealing member from said opening when said collar is removed from said container.

5. The disposable container and sealing assembly of claim 4 wherein the circular projection receives the periphery of said sealing member, and wherein center portions of said periphery bow outwardly and edge portions of said periphery bow inwardly.

6. The disposable container and sealing assembly of claim 5 wherein the contour of said periphery generally corresponds to the contour of the circular projection which receives it.

7. The disposable container and sealing assembly of claim 1 wherein said sealing member seals against penetration or release of gases.

8. The disposable container and sealing assembly of claim 1 wherein said sealing member forms a vacuum seal.

9. The disposable container and sealing assembly of claim 1 wherein said collar is screwed onto the opening of said container.

10. The disposable container and sealing assembly of claim 1 wherein said seal is elastic.

11. The disposable container and sealing assembly of claim 1 including a sealing ring connected to said collar and forming a seal at the end of said collar which is positioned adjacent to said container, opposite to said sealing member.

12. The disposable container and sealing assembly of claim 11 wherein a flange connects said collar and said sealing ring.

13. The disposable container and sealing assembly of claim 12 wherein said flange is integral with said sealing ring.

14. A disposable container having a threaded opening and a sealing assembly having means for indicating that the container has not been opened, which sealing assembly is made of a synthetic material, said sealing assembly comprising:

a sealing member including a disc portion for enclosing the opening of said container and an elastic seal portion formed as a single piece with said disc portion and positioned between said disc portion and said opening; and a collar having a threaded inner surface for engaging the threaded opening of said container and for retaining said sealing member to the opening of said container, at least portions of said inner surface having a circular projection for receiving said sealing member and for removing said sealing member from said opening when said collar is removed from said container;

wherein said disc portion has a central projection which is connected to the remainder of said disc portion by a sloping surface, and wherein said collar has a recess for receiving the central projection of said disc portion and a chamfer for receiving the sloping surface of said disc portion.

15. The disposable container and sealing assembly of claim 14 wherein the circular projection receives the periphery of said sealing member, wherein center portions of said periphery bow outwardly and edge portions of said periphery bow inwardly, and wherein the contour of said periphery corresponds to the contour of the circular projection which receives it.

16. A disposable container having an opening and a sealing assembly having means for indicating that the container has not been opened, said sealing assembly comprising:

a sealing member having a disc for enclosing the opening of said container and a seal positioned between said disc and said opening; and a collar having means for engaging the opening of said container, for retaining said sealing member to the opening of said container;

wherein said collar has an inner surface, at least portions of which are provided with a circular projection for receiving the periphery of said sealing member, and for removing said sealing member from said opening when said collar is removed from said container; and wherein center portions of said periphery bow outwardly and edge portions of said periphery bow inwardly.

17. The disposable container and sealing assembly of claim 16 wherein the contour of said periphery generally corresponds to the contour of the circular projection which receives it.

* * * * *